United States Patent [19]

Heitmann

[11] Patent Number: 5,009,238

[45] Date of Patent: Apr. 23, 1991

[54] APPARATUS FOR SUPPLYING FIBROUS MATERIAL TO MACHINES FOR SIMULTANEOUSLY PRODUCING A PLURALITY OF CIGARETTE RODS

[75] Inventor: Uwe Heitmann, Hamburg, Fed. Rep. of Germany

[73] Assignee: Körber AG, Hamburg, Fed. Rep. of Germany

[21] Appl. No.: 431,473

[22] Filed: Nov. 1, 1989

[30] Foreign Application Priority Data

Nov. 22, 1988 [DE] Fed. Rep. of Germany ..... 3839354

[51] Int. Cl.[5] ..... A24B 7/14

[52] U.S. Cl. ..... 131/108; 131/110

[58] Field of Search ..... 131/108–110; 406/170–171, 180

[56] References Cited

U.S. PATENT DOCUMENTS 2,570,270 10/1951 Patterson ..... 131/108
3,580,645 5/1971 Hagenah .
4,587,979 5/1986 Hagemann .
4,685,476 8/1987 Hagemann .
4,848,369 7/1989 Siems .

*Primary Examiner*—V. Millin
*Assistant Examiner*—Lynne A. Reichard
*Attorney, Agent, or Firm*—Peter K. Kontler

[57] ABSTRACT

Apparatus for supplying comminuted tobacco leaves to the only distributor of a machine for simultaneously producing two cigarette rods employs several gates which can admit batches of tobacco into the magazine of the distributor either simultaneously or one after the other. Each gate has its own inlet for tobacco and an outlet which can be unsealed to dump a batch of accumulated tobacco particles into the distributor. The gates can be disposed at a common level or at several levels, and each gate can extend all the way between the ends of the adjacent magazine. Alternatively, two gates can be disposed end-to-end so that the length of each of these gates equals or approximates half the length of the adjacent magazine. The inlets of the gates can receive comminuted tobacco from a single feeding conduit by way of a mobile connector, and each inlet is located at one longitudinal end of the respective gate.

10 Claims, 2 Drawing Sheets

APPARATUS FOR SUPPLYING FIBROUS MATERIAL TO MACHINES FOR SIMULTANEOUSLY PRODUCING A PLURALITY OF CIGARETTE RODS

BACKGROUND OF THE INVENTION

The invention relates to machines for producing rods which contain fibrous material, especially for simultaneously producing a plurality of rods which contain fibrous material. Typical examples of such rods are cigarette rods wherein a filler of shredded and/or otherwise comminuted natural, reconstituted and/or artificial tobacco is confined in a tubular wrapper of cigarette paper or the like. More particularly, the invention relates to improvements in apparatus for supplying fibrous material to machines for producing rods, especially for simultaneously producing plural rods, wherein a rod-like filler of fibrous material is confined in a tubular envelope.

The apparatus for supplying fibrous material (shredded tobacco) to a cigarette rod making machine which turns out several cigarette rods (normally two cigarette rods) comprises a distributor wherein the fibrous material is prepared for conversion into plural streams which are thereupon trimmed to be converted into rod-like fillers which are ready for draping into cigarette paper or other suitable wrapping material.

Commonly owned copending patent application Ser. No. 057,783 filed June 3, 1987 by Uwe Heitmann and Peter Brand for "Method of and apparatus for simultaneously making plural tobacco streams", now U.S. Pat. No. 4,889,138 granted Dec. 16, 1989, discloses an apparatus which converts a single stream of fibrous material into two smaller streams each of which is ready for trimming and subsequent draping. A very important prerequisite for simultaneous making of satisfactory plural cigarette rods wherein the fillers consist of trimmed tobacco streams which are obtained as a result of breaking up a larger flow is to ensure that the desirable characteristics (such as the uniformity of mixture of different blends of tobacco, the weight per unit length, the density of the fillers and/or the hardness of the fillers) of one rod will exactly match the respective characteristics of each other rod. This necessitates the provision of an apparatus which is capable of ensuring the making of a homogeneous large flow, i.e., of a flow which can be subdivided into several streams each of which has the same density, hardness and/or other characteristics which are desirable to the smoker and to the manufacturer of cigarettes, cigars, cigarillos, filter rod sections and/or other rod-shaped articles of the tobacco processing industry.

OBJECTS OF THE INVENTION

An object of the invention is to provide a novel and improved apparatus which can be used to supply fibrous material to a machine serving to produce at least one rod, especially to simultaneously produce two or more rods containing rod-like fillers of fibrous material within tubular wrappers of cigarette paper, artificial cork or other suitable wrapping material.

Another object of the invention is to provide an apparatus which ensures the making of a highly homogeneous flow of fibrous material prior to subdivision of the flow into two or more streams.

A further object of the invention is to provide a machine for making cigarette rods or the like, particularly for simultaneously making plural cigarette rods, which receives fibrous material from the above outlined apparatus.

An additional object of the invention is to provide a novel and improved apparatus which can supply fibrous material into the distributor of a cigarette rod making or like machine.

Still another object of the invention is to provide an apparatus which is constructed, assembled and operated in such a way that undertakings to ensure the building of two or more identical streams of fibrous material can begin as soon as the material enters, or while the fibrous material is in the process of entering, the distributor.

A further object of the invention is to provide novel and improved means for supplying and/or otherwise manipulating two or more types of tobacco or other fibrous material ahead of the distributor in a machine for producing a cigarette rod or the like, particularly for simultaneously producing a plurality of cigarette rods or the like.

An additional object of the invention is to provide novel and improved arrays of sluices or gates which can be used in the above outlined apparatus to supply fibrous material to the distributor of a machine for turning out one or more cigarette rods or the like.

Another object of the invention is to provide a novel and improved method of regulating the admission of fibrous material into the distributor of a cigarette rod making or like machine.

An additional object of the invention is to provide a method which renders it possible to beneficially influence the quality of a stream of fibrous material at, or even ahead of, the station where the admitted fibrous material is gathered into a flow of tobacco shreds, comminuted tobacco ribs and/or other fibrous materials which are used in plain or filter cigarettes, cigars or cigarillos or in rod-like sections of filters for tobacco smoke.

SUMMARY OF THE INVENTION

The invention is embodied in an apparatus for supplying fibrous material (such as natural, reconstituted and/or artificial tobacco) to a machine for the making of one or more rods which are to be subdivided into rod-shaped articles (such as plain cigarettes, cigars or cigarillos) of the tobacco processing industry. The improved apparatus comprises a distributor and a plurality of sluices or gates each having an inlet for reception of fibrous material. The gates have outlet means for admission of fibrous material into the distributor.

In accordance with a first presently preferred embodiment of the invention, each gate extends longitudinally of and is disposed above an elongated upper portion (e.g., a portion including a magazine) of the distributor. The arrangement may be such that the inlet of a first gate is adjacent one end of the upper portion and the inlet of a second gate is disposed at the other end of the upper portion of the distributor.

Alternatively, the first and second gates can be disposed substantially end-to-end so that each thereof extends along and above approximately or exactly one-half of the elongated upper portion of the distributor. The inlet of the first gage can be disposed at one end, and the inlet of the second gate can be disposed at the other end of the upper portion of the distributor. The first and second gates can be disposed at the same level and can be mirror images of each other.

The just described apparatus can be modified by locating the first and second gates at different levels. It is then possible to place the inlet of the first gate at one end of the elongated upper portion of the distributor and to place the inlet of the second gate adjacent the first gate, i.e., the inlets of the first and second gates can face in the same direction.

Irrespective of the selected length and mutual positioning of the gates, each inlet is preferably provided in one of the two end portions of the respective gate, namely in one of those portions which extend transversely of the elongated upper portion of the distributor.

The means for feeding fibrous material to the inlets of the gates can include a conduit having a discharge end, and a connector which is movable between a plurality of positions in each of which the connector establishes a path for the flow of fibrous material from the discharge end of the conduit to the inlet of a different gate. If the apparatus comprises two gates, the connector can be provided with a first channel which establishes a path between the discharge end of the conduit and the inlet of the first gate in a first position of the connector, and a second channel which establishes a path between the discharge end of the conduit and the inlet of the second gate in a second position of the connector.

Each path is or can be substantially vertical, and the connector can be disposed at a level between the discharge end of the conduit and the inlets of the gates.

The outlet means can include a discrete sealable outlet for each gate, and the apparatus can further comprise means for simultaneously unsealing a plurality of outlets, i.e., for simultaneously unsealing both outlets if the apparatus comprises two gates.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
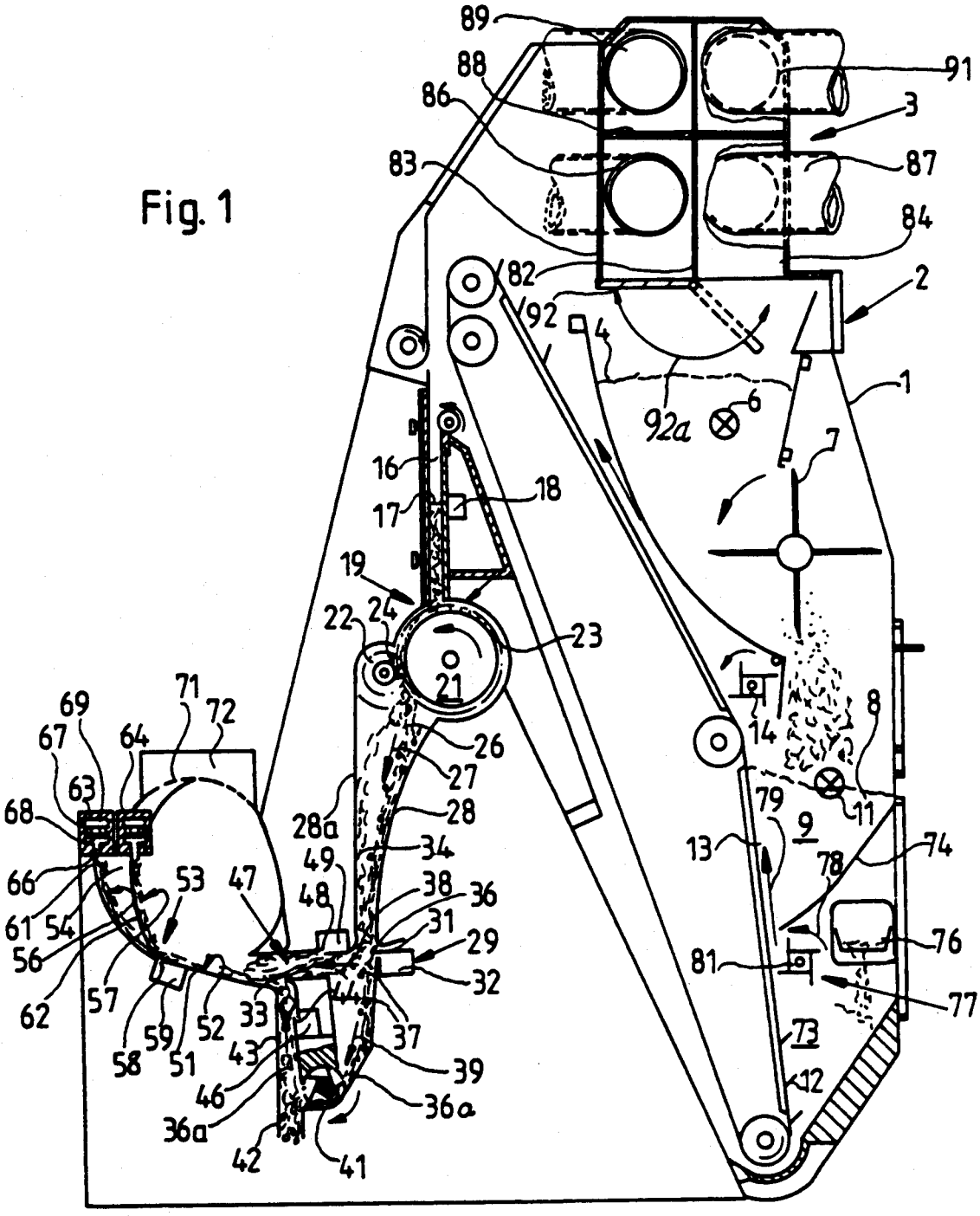
FIG. 1 is a fragmentary partly elevational and partly vertical sectional view of a machine which is designed to simultaneously produce two cigarette rods and wherein the tobacco supplying apparatus is constructed in accordance with a first embodiment of the invention.

FIG. 1 shows the distributor and certain other parts of a machine which is designed to simultaneously produce two continuous cigarette rods. The distributor (also called hopper) comprises an upper portion 2 which constitutes or includes a magazine 1 and serves for admission of metered quantities of fibrous material (primarily shredded tobacco leaf laminae) into a second or main magazine 9. The upper portion 2 can be said to constitute a means for effecting a coarse or preliminary distribution of fibrous material which is delivered in the form of batches by a novel material supplying apparatus 3 having two sluices or gates 83, 84 at a level above the upper portion 2. The apparatus 3 delivers one or more portions or batches of fibrous material in response to signals which are generated by an optical level monitoring device 6 in or on the magazine 1, namely when the upper surface of the supply 4 of fibrous material in the magazine 1 descends to a predetermined level.

The means for transferring fibrous material from the supply 4 in the magazine 1 into the magazine 9 comprises a rotary rake 7 which is started in response to signals from a second optical monitoring device 11 installed in or on the magazine 9 and serving to generate a signal when the upper surface of the supply 8 of fibrous material in the magazine 9 descends to a predetermined level. The arrangement is preferably such that the level of the upper surface of the supply 8 of fibrous material in the magazine 9 fluctuates very little or not at all.

An endless elevator conveyor 13 has a plurality of relatively small equidistant pockets 12 for advancement of small batches of fibrous material from the supply 8 into an upright duct 16. A paddle wheel 14 is used to equalize the quantities of fibrous material in successive pockets 12 of the elevator conveyor 13 by brushing away those shreds and/or other particles of tobacco leaves which project upwardly and outwardly beyond the respective pockets 12.

The upper surface of the column 17 of fibrous material in the duct 16 is monitored by one or more photoelectronic detectors 18, and the open lower end of the duct 16 is adjacent the carding 23 of a rotary drum 21 forming part of a withdrawing unit 19. The latter further includes a rapidly rotating picker roller 22 with radially extending pin-shaped projections 24 which serve to expel fibrous material from the carding 23 and to propel a shower 26 of fibrous material into a funnel-shaped channel or duct 28. The detector or detectors 18 generate signals which are used to control the operation of the motor means (not shown) for the elevator conveyor 13 in a sense to ensure that the upper surface of the column 17 of fibrous material in the duct 16 will remain at or close to a selected level. The RPM of the picker roller 22 preferably greatly exceeds the RPM of the carded drum 21.

The shower 26 of fibrous material which is expelled from the carding 23 of the drum 21 descends (note the arrow 27) in the substantially funnel-shaped upright channel 28 which narrows in a direction downwardly of and away from the withdrawing unit 19. The particles of the shower 26 are accelerated by one or more substantially horizontal jets of compressed air or another gaseous fluid issuing from the orifice or orifices of one or more nozzles 31 forming part of an accelerating device 29 which further includes a plenum chamber 32 serving to supply compressed gaseous fluid to the nozzle or nozzles 31. The thus accelerated lighter particles 33 of fibrous material are propelled transversely (arrow 38) of the direction which is indicated by the arrow 27 and are thereby segregated from heavier particles 37 (e.g., fragments of tobacco ribs) which traverse the horizontal curtain of compressed gaseous fluid and continue to descend in the direction indicated by an arrow 39.

The lighter particles 33 normally include relatively long tobacco shreds 34 and some shorter tobacco shreds 36. Some lighter tobacco shreds 36a are entrained by heavier particles 37 which traverse the curtain of classifying gaseous fluid and are evacuated from the channel 28 by a rotary cell wheel 41. The particles 37 and 36a enter a further duct 42 wherein the particles 37 descend to be evacuated from the distributor. The lighter particles 36a are aspirated by an upwardly flowing stream of air which is drawn into a substantially upright channel 43 due to injector effect of a stream of compressed gaseous fluid issuing from the nozzle 44 of a plenum chamber 46. The channel 43 admits lighter particles 36a into the mixture of particles 34 and 36 which advance in the direction of arrow 38.

As can be seen in FIG. 1, the pins 24 of the rapidly rotating picker roller 22 propel the lighter particles 34 against the left-hand wall 28a of the channel 28. This is desirable and advantageous because the particles 34 are unable to entrain relatively short particles (such as some of the heavier particles 37). Thus, all heavier particles (particularly fragments of tobacco ribs) are free to traverse the curtain of compressed gaseous fluid which is discharged by the orifice or orifices of the nozzle or nozzles 31, and all such heavier particles enter the cell wheel 41 to be evacuated from the distributor by way of the channel 42.

The reference character 47 denotes a mixing zone wherein the particles 34, 36 are mixed with each other and with the particles 36a to form a relatively large flow or stream 52 which is caused to advance in the direction of arrow 38 by one or more jets of compressed gaseous fluid issuing from one or more nozzles 48 forming part of or receiving compressed gaseous fluid from a plenum chamber 49. Successive increments of the flow 52 advance along the upper side of a guide 51 which is located downstream of the nozzle 49 and is closely hugged by the flow 52 during advancement toward a dividing or splitting zone 53 wherein a partition 54 divides the flow 52 into two discrete smaller flows or streams 56 and 57. Forward and upward movement of successive increments of each of the streams 56, 57 is caused by jets of compressed gaseous fluid which are discharged by the nozzle or nozzles 58 of a further plenum chamber 59 ahead of the locus where the flow 52 is divided into the streams 56 and 57.

The streams 56 and 57 respectively advance along the concave surfaces of two guides 61, 62 which are separated from each other by the partition 54 and direct the streams 56, 57 into two substantially horizontal channels 66 at the undersides of lower reaches of two endless foraminous belt conveyors 68 which are spaced apart from and are preferably parallel to each other. The jets of compressed gaseous fluid which is supplied by the plenum chamber 59 and is discharged by the nozzle or nozzles 58 ensure that the streams 56 and 57 closely hug the concave upper sides of the guides 61 and 62 on their way into the channels 66 beneath the lower reaches of the respective belt conveyors 68.

The conveyor 68 which receives and entrains the stream 56 forms part of a first pneumatic stream transporting unit 63 which further includes a suction chamber 69 having a perforated bottom wall 68 above the lower reach of the left-hand conveyor 68. A second stream transporting unit 64 which receives fibrous material from the guide 62 is preferably identical with the aforedescribed unit 63. The suction chambers 69 ensure that the fibrous materials of the streams 56 and 57 adhere to the undersides of the lower reaches of the respective foraminous conveyors 68. These conveyors advance the respective streams past trimming devices which remove the surplus and thereupon into the range of wrapping mechanisms wherein the thus obtained rod-like fillers of fibrous material are draped into webs of cigarette paper or other suitable wrapping material to form with the wrapping material two discrete cigarette rods or other rods of the tobacco processing industry which are ready to be subdivided into discrete rod-like sections of desired length. Reference may be had, for example, to commonly owned copending patent application Ser. No. 275,078 filed Nov. 22, 1988 by Uwe Heitmann et al. which discloses trimming devices for simultaneously equalizing a plurality of tobacco streams, and to commonly owned U.S. Pat. No. 4,848,369 to Siems which discloses a method of and a machine for simultaneously producing a plurality of cigarette rods.

The partition 54 is adjustable transversely of the direction (arrow 38) of advancement of the flow 52 and streams 56, 57 toward the respective pneumatic transporting units 63, 64. This renders it possible to alter the rate at which the fibrous material of the flow 52 is divided to advance along the guides 61 and 62. The purpose of such adjustability of the partition 54 is to ensure that each of the two discrete streams 56, 57 will carry identical quantities of fibrous material. The means for adjusting the partition 54 in directions at right angles to the plane of FIG. 1 can include means for monitoring the distribution of fibrous material in the flow 52 (i.e., on the guide 51) and/or for monitoring the quantity of fibrous material in the channels 66 of the units 63, 64 and/or for monitoring the mass or density of fibrous material which advances toward the trimming devices serving to remove the surplus and to convert the respective streams 56, 57 into rod-like fillers which are ready for draping into cigarette paper or the like. For example, and assuming that the monitoring means serves to monitor the distribution of fibrous material on the guide 51, the partition 54 will be moved away from the observer of FIG. 1 if the quantity of fibrous material in the stream 56 exceeds the quantity of fibrous material in the stream 57, and vice versa.

The gaseous carrier medium which is used to transport the flow 52 and the streams 56, 57 escapes through a sieve 71 into an expansion chamber 72.

The surplus which is removed by the aforediscussed trimming or equalizing devices from the streams at the undersides of the lower reaches of the conveyors 68 is preferably returned into the distributor. FIG. 1 shows a portion of a conveyor 76 (e.g., an endless belt conveyor or a vibratory conveyor) which discharges the returned surplus into a receptacle 73 beneath the magazine 9. Small batches of returned surplus are picked up by successive pockets 12 of the elevator conveyor 13, and the quantities of surplus in the pockets 12 are equalized by a paddle wheel 81 which forms part of an equalizing unit 77 and is driven to rotate in a counterclockwise direction (arrow 78), i.e., counter to the direction of upward movement of the pockets 12. The partially filled pockets 12 leave the receptacle 77 in the direction of arrow 79 and pick up fibrous material from the supply 8 in the magazine 9 on their way toward the upper end turn of the elevator conveyor 13 where the contents of successive pockets 12 are dumped into the duct 16. The reference character 74 denotes the bottom wall of the magazine 9; this bottom wall separates the supply 8 from the supply of returned surplus fibrous material in the receptacle 73. The illustrated paddle wheel 81 includes a square or rectangular carrier which supports four equidistant vanes or paddles and is rotated about a horizontal axis.

Figure 2A:
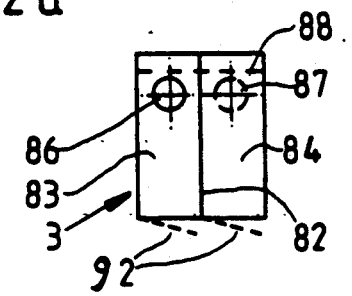
FIG. 2*a* is a schematic end elevational view of the gates in the apparatus of FIG. 1.
Figure 2B:
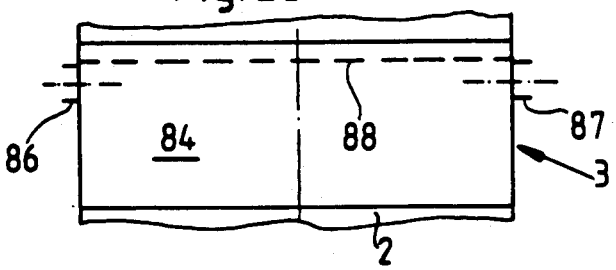
FIG. 2*b* is a schematic side elevational view of one of the gates which are shown in FIGS. 1 and 2*a*.

The apparatus 3 which is shown in FIGS. 1 and 2*a*–2*b* and serves to supply batches of fibrous material into the elongated upper portion 2 of the distributor comprises the aforementioned sluices or gates 83, 84 each of which extends (at right angles to the plane of FIG. 1) the full length of the upper portion 2. These gates are separated from each other by an elongated vertical wall 82. The inlet 86 of the gate 83 is disposed at one end of the upper portion 2, and the inlet 87 of the gate 84 is located at the other end of the upper portion 2. A sieve or filter 88 in the apparatus 3 serves to segregate fibrous material (which has been admitted via inlets 86, 87) from the carrier fluid (normally air). The carrier fluid which leaves the gate 83 by flowing upwardly through the sieve 88 is evacuated by way of a first pipe 89, and the carrier fluid which leaves the gate 84 by flowing upwardly through the sieve 88 is evacuated by way of a second pipe 91.

FIG. 1 shows a pivotable flap 92 which is mounted at the lower end of the wall 82 and can be pivoted (e.g., by a pneumatically, hydraulically or otherwise operated pivoting device indicated by a double headed arrow 92*a*) between the illustrated solid-line position in which the outlet of the gate 83 is sealed, and a second position in which the outlet of the gate 83 is free to discharge a batch of fibrous material into the magazine 1 but the outlet of the gate 84 is sealed. An intermediate position of the flap 92 is shown in FIG. 1 by broken lines.

FIG. 2*a* shows that the outlets of the gates 83 and 84 can be sealed or exposed by two discrete flaps or like sealing and unsealing devices which can be operated to simultaneously unseal the two outlets or to unseal one outlet while the other outlet is sealed and vice versa.

It has been found that the provision of a plurality of discrete gates ensures a much more satisfactory distribution of fibrous materials, which are delivered via inlets 86 and 87, across the full length and width of the upper portion 2 and its magazine 1 than if the magazine 1 were to receive batches of fibrous material from a signal gate. The provision of inlets 86, 87 at opposite longitudinal ends of the elongated upper portion 2 also contributes to more uniform distribution of fibrous material in the magazine 1. As a rule, it suffices to provide two discrete gates; however, it is equally within the purview of the invention to double the number of gates in the apparatus 3 so that the inlets of two gates are disposed at one longitudinal end and the inlets of the other two gates are located at the other longitudinal end of the upper portion 2.

It was further discovered that, by multiplying the number of gates, one ensures more uniform mixing of fibrous material in the magazine 1 which contributes to homogeneousness of the streams 56 and 57. All in all, the improved apparatus contributes to more satisfactory distribution and intermixing of particles of fibrous material at the very locus where the particles enter the distributor of the rod making machine. As mentioned above, it is very important that each cigarette rod issuing from a cigarette making machine which simultaneously produces two or more cigarette rods contain identical quantities of fibrous material per unit of length as well as that all other desirable characteristics of one of the rods invariably match the respective characteristics of each other rod. These additional or other characteristics can include hardness, density, homogeneousness and resistance to flow of tobacco smoke through their fillers. The term "homogeneousness" is intended to denote uniform distribution of fibrous material in each increment of a rod as well as uniform intermixing of two or more blends of fibrous material in the filler.

Gates or sluices of the type capable of being put to use in the apparatus of FIGS. 1, 2*a* and 2*b* are disclosed, for example, in commonly owned U.S. Pat. Nos. 3,580,645 to Hagenah, 4,587,979 to Hagemann et al., and 4,685,476 to Hagemann et al. The disclosures of these patents, as well as of the aforementioned copending patent application Ser. No. 057,783 (now U.S. Pat. No. ) are incorporated herein by reference.

If the flap or flaps or other sealing means for the outlets of the gates 83, 84 are designed to unseal the respective gates in a selected sequence (e.g., alternatingly if the supplying apparatus comprises two gates), such method of admitting batches of fibrous material into the magazine 1 of the distributor ensures, in the long run, the building of a more uniform flow 52 of fibrous material prior to breaking up of the flow into a plurality of separate streams such as the streams 56 and 57. This is due to the fact that each gate receives and discharges the same or nearly the same quantity of fibrous material per unit of time. However, highly satisfactory results can also be obtained if the outlet of each gate is provided with its own sealing means and if such sealing means are actuated to open simultaneously, i.e., so that both gates or all of the gates simultaneously admit batches of fibrous material into the magazine 1 in the upper portion 2 of the distributor in a machine which is designed to simultaneously turn out one or more rods with fillers of fibrous material confined in tubular envelopes of cigarette paper, artificial cork or the like. Simultaneous unsealing of the outlets of gates is preferred at this time.

Figure 3A:
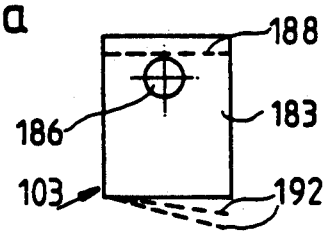
FIG. 3*a* is a schematic end elevational view of one of two modified gates.
Figure 3B:
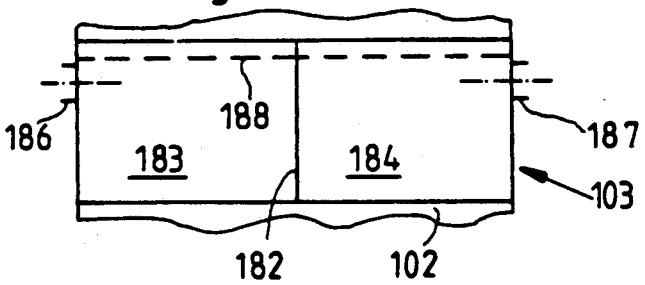
FIG. 3*b* is a view as seen from the right-hand side of FIG. 3*a*.

FIGS. 3*a* and 3*b* show a portion of a second apparatus 103. All such parts of this apparatus which are identical with or clearly analogous to the corresponding parts of the apparatus 3 of FIGS. 1 and 2*a*–2*b* are denoted by similar reference characters plus 100. The main difference between the apparatus 3 and 103 is that the gates 183, 184 are shorter than the magazine of the upper portion 102 of the distributor. The length of each gate 183, 184 is preferably half the length of a gate 83 or 84, and the gates 183, 184 are disposed at the same level and end-to-end. The inlet 186 of the gate 183 is disposed at one longitudinal end of the upper portion 102, and the inlet 187 of the gate 184 is located at the other axial end of the upper portion 102. The wall 182 is disposed between the gates 183, 184, e.g., exactly or substantially midway between the longitudinal ends of the upper portion 102 of the distributor. However, it is equally within the purview of the invention to employ a relatively long gate and a shorter gate and to place such shorter and longer gates end-to-end on top of the upper portion 102 of the distributor.

Figure 4A:
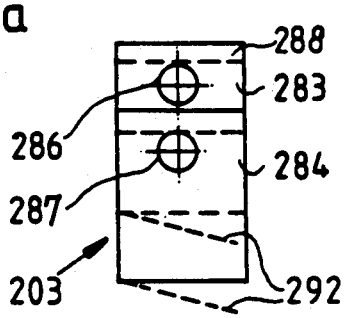
FIG. 4*a* is an end elevational view of two gates which are disposed at different levels.
Figure 4B:
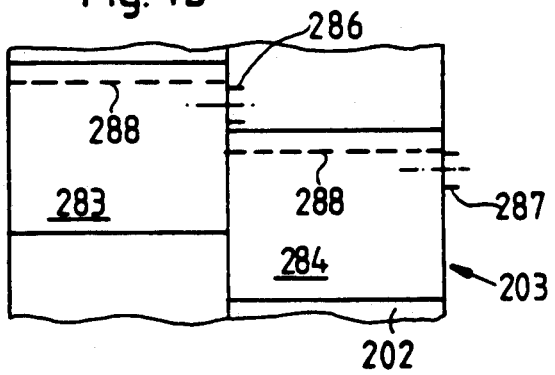
FIG. 4*b* is a view as seen from the right-hand side of FIG. 4*a*.

The apparatus 203 of FIGS. 4a and 4b constitutes a modification of the apparatus 103, i.e., it also comprises two relatively short gates 283, 284 which are disposed end-to-end above the upper portion 202. However, the gates 283, 284 are located at different levels and the apparatus 203 employs two discrete sieves or filters 288 which are also located at different levels. An advantage of the vertically staggered positioning of the gates 283, 284 is that the inlet 286 of the gate 283 can be placed adjacent the gate 284 and thus faces in the same direction as the inlet 287 at the right-hand end of the upper portion 202 (as seen in FIG. 4b).

The inlets of all gates preferably receive batches of fibrous material from pneumatic conveyors.

The flaps 192 at the outlets of the gates 183, 184 are located at the same level and can be pivoted simultaneously or independently of each other. The same applies for the flaps 292 at the outlets of the gates 283, 284; however, the flaps 292 are disposed at different levels due to staggering of the respective gates.

Each embodiment of the improved apparatus preferably employs inlets each of which is disposed in one end portion of the respective gate, i.e., in one of the two spaced-apart portions which extend transversely of the longitudinal direction of the upper portion 2, 102 or 202 of the distributor.

Figure 5A:
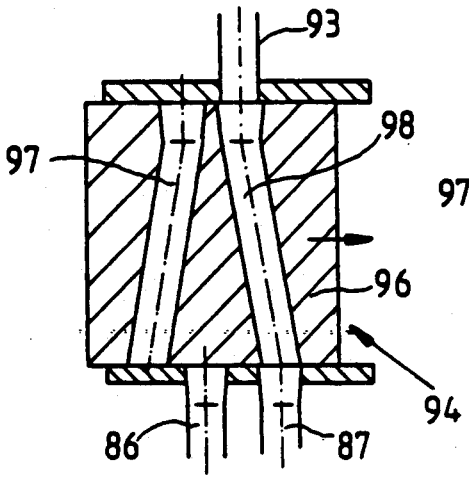
FIG. 5*a* is a fragmentary schematic sectional view of a device which supplies fibrous material to the inlets of the gates, the connector of the supplying device being shown in a first position.
Figure 5B:
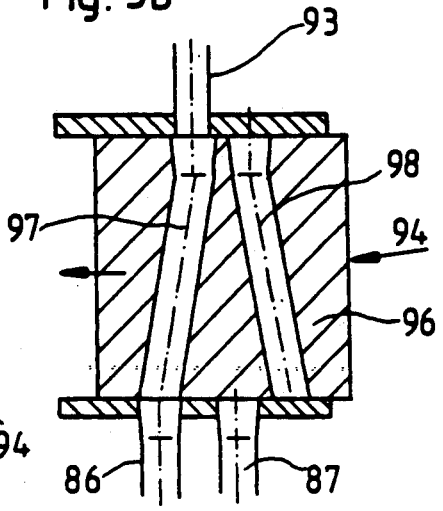
FIG. 5*b* shows the structure of FIG. 5*a* but with the connector in a second position.

One presently preferred embodiment of means 94 for feeding fibrous material to the inlets of the gates is shown in FIGS. 5a and 5b. The feeding means 94 comprises a conduit 93 (e.g., an upright tube) having a discharge end adjacent the upper side of a reciprocable connector 96 which is movable between a plurality of positions, namely a different position for each of the gates in the respective supplying apparatus. FIGS. 5a and 5b illustrate portions of inlets 86, 87 of the gates 83, 84 of FIGS. 1, 2a and 2b. The connector 96 is a slide which is movable at a level between the discharge end of the conduit 93 and the upper ends of the inlets 86, 87 and has two suitably configurated channels 97 and 98. The channel 97 establishes a substantially vertical path for the flow of fibrous material from the discharge end of the conduit 93 into the inlet 86 in one position of the connector 96 (FIG. 5b). The channel 98 establishes a substantially vertical path for the flow of fibrous material from the discharge end of the conduit 93 into the inlet 87 of the gate 83 in another position of the connector 96 (see FIG. 5a).

Of course, it is equally possible to provide a discrete conduit 93 for each of the inlets 86, 87 and to provide suitable valves or other blocking devices which can be actuated to permit or prevent the flow of fibrous material into the corresponding inlet. The feeding means 94 of FIGS. 5a and 5b is preferred at this time due to its simplicity and compactness. The mounting of the slide-like connector 96 at a level between the discharge end of the conduit 93 and the upper ends of the inlets 86, 87 is desirable and advantageous on the additional ground that fragments of fibrous material are less likely to gather between the surfaces of the reciprocable connector and the adjacent stationary parts. The likelihood of such accumulation of fibrous material adjacent the connector 96 is reduced primarily because the channels 97 and 98 permit fibrous material to descend by gravity in each of the two illustrated positions of the connector.

It is further possible to employ a connector which is indexible between a plurality of different positions in each of which it establishes a path for the flow of fibrous material from a single conduit to two or more discrete gates. The arrangement may be such that the indexible connector has a single channel the intake end of which is in continuous communication with a conduit (such as the conduit 93 of FIGS. 5a and 5b) and the discharge end of which communicates with the inlet of a different gate in each of several different angular positions of the connector.

Still further, it is possible to place the intake end of a swingable or otherwise movable pipe next to the discharge end of the conduit 93 and to move the discharge end of such pipe into register with the inlets of two or more discrete gates.

All embodiments of the improved supplying apparatus exhibit the advantage that the inlets of the gates can be placed in optimum positions for reception of fibrous material from above or in the longitudinal direction of the respective gates. In addition, and as already mentioned above, the improved apparatus ensures more uniform distribution of fibrous material longitudinally of the upper portion of the distributor and contributes to homogeneousness of material which is transferred into the magazine 9 of the distributor.

The apparatus 3, 103 or 203 further ensures that the quantity of tobacco or other fibrous material at one end of the respective magazine (such as the magazine 1 of FIG. 1) matches or approximates the quantity of fibrous material at the opposite end of the magazine. This holds particularly true for the apparatus 3 wherein the inlets 86, 87 are located at opposite ends of the magazine 1. Thus, fibrous material which is admitted via inlet 86 can be propelled all the way to the right-hand end of the magazine 1 (as seen in FIG. 2b), and fibrous material which is admitted via inlet 87 can be propelled all the way to the left-hand end wall of the magazine. If the apparatus 3 were to be replaced with an apparatus having a single gate with the inlet at one end of the upper portion of the distributor, the admitted fibrous material would invariably pile up at the other end of the magazine. This would affect the uniformity of admission of fibrous material into the main magazine of the distributor (corresponding to the magazine 9 of FIG. 1). In addition, if fibrous material is admitted by way of the inlet at one end of a single gate, the fibrous material is likely to undergo pronounced segregation as soon as it enters the distributor. This is highly undesirable if the fibrous material is a mixture of two or more blends of tobacco or contains relatively large percentages of lightweight and heavier particles. Thus, the heavier particles are likely to be propelled at a maximum distance from the inlet and the lighter particles tend to deposit as soon as they enter the gate. The distribution is much more uniform if the supplying apparatus comprises at least two gates which are positioned in a manner as shown in FIGS. 1 and 2a-2b, i.e., wherein the inlets 86, 87 are disposed at opposite longitudinal ends of the magazine 1.

Another important advantage of the improved apparatus is that the segregation of particles of fibrous material into larger and smaller and/or heavier and lighter and/or longer or shorter and/or puffed or unpuffed fragments of tobacco leaves or the like is greatly reduced. Thus, even though some segregation of material which is admitted into the inlets 86, 87 of the respective gates 83 and 84 will take place in the gates themselves (for example, the trajectories of heavier particles will be longer than those of the shorter particles), segregation of particles in the gate 83 takes place from one end toward the other end of the upper portion 2 and segregation of particles in the other gate takes place from the other end toward the one end of the upper portion 2 so that the effect of segregation in the two gates is neutralized when the thus obtained batches are caused to descend into the magazine 1. In the long run, and assuming that the number of batches which are discharged by one of the gates per unit of time matches or closely approximates the number of batches which are discharged by the other gate, the homogeneousness of the flow 52 and streams 56, 57 is much more pronounced than if the distributor were to receive fibrous material from a single gate. This holds especially true as regards the distribution of various ingredients of the flow 52, including the distribution of longer tobacco shreds, the distribution of shorter tobacco shreds, the distribution of heavier particles and the distribution of lighter particles if the flow 52 consists of fragments of natural tobacco leaves, fragments of sheets of reconstituted tobacco and/or fragments of artificial or substitute tobacco.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for supplying fibrous material, such as tobacco, to a machine for simultaneously making a plurality of rods each of which is to be subdivided into rod-shaped articles of the tobacco processing industry, comprising a distributor; a plurality of gates each having an inlet for reception of fibrous material, said gates further having outlet means for admission of fibrous material into said distributor; means for conveying fibrous material from said distributor; and means for dividing the conveyed fibrous material into a plurality of discrete streams.

2. The apparatus of claim 1, wherein said distributor includes an elongated upper portion and each of said gates extends longitudinally of and is disposed above said upper portion, said gates including a first gate and a second gate, the inlet of said first gate being disposed at one end and the inlet of said second gate being disposed at the other end of said elongated upper portion.

3. The apparatus of claim 1, wherein said distributor includes an elongated upper portion and each of said gates extends longitudinally of and is disposed above said upper portion, said gates including a first gate and a second gate, said first and second gates being disposed substantially end to end.

4. The apparatus of claim 3, wherein said first and second gates are located at the same level and are mirror images of each other.

5. The apparatus of claim 3, wherein the inlet of said first gate is disposed at one end and the inlet of said second gate is disposed at the other end of said elongated upper portion.

6. The apparatus of claim 1, wherein said distributor includes an elongated upper portion and each of said gates has two end portions extending transversely of said upper portion, each of said inlets being provided in one end portion of the respective gate to admit fibrous material substantially longitudinally of said upper portion, said gates being disposed above said upper portion.

7. The apparatus of claim 1, wherein said outlet means includes a discrete sealable outlet for each of said gates and further comprising means for simultaneously unsealing a plurality of said discrete outlets.

8. Apparatus for supplying fibrous material, such as tobacco, to a machine for the making of rods which are to be subdivided into rod-shaped articles of the tobacco processing industry, comprising a distributor; a plurality of gates each having an inlet for reception of fibrous material, said gates further having outlet means for admission of fibrous material into said distributor; and means for feeding fibrous material to said inlets, including a conduit having a discharge end and a connector movable between a plurality of positions in each of which said connector establishes a path for the flow of fibrous material from said discharge end to the inlet of a different gate.

9. The apparatus of claim 8, wherein said gates include a first gate and a second gate, said connector having a first channel which establishes a path between said discharge end and the inlet of said first gate in a first position of said connector, and a second channel which establishes a path between said discharge end and the inlet of said second gate in a second position of said connector.

10. The apparatus of claim 8, wherein each path for the flow of fibrous material is substantially vertical, said connector being disposed at a level between said discharge end and said gates.

* * * * *